US006871846B2

(12) United States Patent
Antill

(10) Patent No.: US 6,871,846 B2
(45) Date of Patent: Mar. 29, 2005

(54) SUCTION-ATTACHED SUPPORT DEVICE AND METHOD

(76) Inventor: Keith R. Antill, 88 Dogwood Trail Dr., Stockbridge, GA (US) 30281

( * ) Notice: Subject to any disclaimer, the term of this patent is extended or adjusted under 35 U.S.C. 154(b) by 49 days.

(21) Appl. No.: 10/391,975

(22) Filed: Mar. 18, 2003

(65) Prior Publication Data

US 2004/0182018 A1 Sep. 23, 2004

(51) Int. Cl.[7] ..... B25B 11/00; G01B 5/16

(52) U.S. Cl. ..... 269/21; 269/904; 52/747.1; 33/647; 33/DIG. 2

(58) Field of Search ..... 269/21, 904, 910; 33/646–649, DIG. 2; 52/747.1, 748.1, 748.11, DIG. 1; 248/205.5, 205.8, 205.9

(56) References Cited

U.S. PATENT DOCUMENTS 3,207,503 A * 9/1965 Clover, Jr. et al. ..... 269/21
4,155,175 A * 5/1979 Stiles ..... 33/646
4,899,459 A * 2/1990 Taggart ..... 33/646
5,224,808 A 7/1993 Macris
5,290,019 A 3/1994 Beyers
5,398,632 A 3/1995 Goldbach et al.
5,457,868 A * 10/1995 Blaimschein ..... 269/21
5,516,019 A 5/1996 Moon
5,536,559 A * 7/1996 Cerrina et al. ..... 269/21
5,551,657 A 9/1996 Liethen
5,586,159 A * 12/1996 Kitaoka et al. ..... 269/21
5,692,311 A * 12/1997 Paquin ..... 33/647
5,695,159 A 12/1997 Adams
5,772,170 A 6/1998 Tsukushi
5,820,116 A 10/1998 Haese
5,909,758 A 6/1999 Kitamura
6,308,923 B1 10/2001 Howard
6,328,459 B1 12/2001 Adams
6,382,574 B1 5/2002 Pando
6,413,022 B1 7/2002 Sarh
6,485,009 B2 * 11/2002 Kashiwazaki et al. ..... 269/21

* cited by examiner

*Primary Examiner*—G. Bradley Bennett
(74) *Attorney, Agent, or Firm*—Gardner Groff, P.C.

(57) ABSTRACT

A body has a support surface for temporarily supporting a siding, trim, or other construction piece that is to be installed on a building wall. A suction cup is controllable to temporarily adhere by suction the support device to the building wall. An extendible spacer is used to accurately position the support device on the building wall. Notches in the body receive the ends of a tape measure or chalk line for accurately sizing and positioning the construction pieces. The support device can be used with existing compressors, vacuum pumps, or other suction-inducing devices. A venturi tube in the body generates the suction when an air compressor is used. A method of installing the siding, trim, or other construction pieces is also provided.

20 Claims, 3 Drawing Sheets

SUCTION-ATTACHED SUPPORT DEVICE AND METHOD

TECHNICAL FIELD

The present invention relates to building construction and maintenance devices and methods and, more particularly, to vacuum-suctioning devices and methods for installing siding, trim, and/or other construction pieces.

BACKGROUND OF THE INVENTION

Siding, trim, and other construction pieces are usually too long, cumbersome, and heavy for one person to properly position on a building, hold there in place, and nail or otherwise permanently affix to the building. Typically, these types of jobs require at least two people, an installer to do the nailing and a helper to help position and hold the siding piece in place. But sometimes a helper is not available or is too costly, and then the installer can not do the job by himself. This results in delays and/or increased costs in constructing or maintaining the building.

Accordingly, what is needed but not found in the prior art is a way for one person to install siding, trim, and/or other construction pieces by himself without the assistance of a helper. In particular, there is a need for a construction device and method that takes the place of a helper and thus helps position and hold the construction piece to be installed in place so the installer can nail it there. It is to the provision of such a construction device and method that the present invention is primarily directed.

SUMMARY OF THE INVENTION

The present invention is a suction-attached support device and method for use with at least one suction-inducing device to temporarily support a siding, trim, or other construction piece during installation on a building structure. Generally described, the device includes a body, a suction cup attached to the body, and a fluid line connector in fluid communication with the suction cup. The body has at least one support surface for supporting the construction piece in place during installation. The suction cup attaches the support device to the structure temporarily when suction is generated in the suction cup. And the fluid line connector can be sed to connect the device to the suction-inducing device for generating suction in the suction cup. As used herein, "suction cup" is intended to refer to any element having a chamber, recess or void, that can be applied to a surface and a vacuum or reduced pressure applied to retain the element against the surface.

In a first exemplary embodiment of the present invention, the device includes a venturi tube with an inlet fluid line, an outlet fluid line, and a suction fluid line. The inlet fluid line is connected to the fluid line connector for introducing fluid into the venturi tube, the outlet fluid line exhausts the fluid from the venturi tube, and the suction fluid line is connected to the suction cup for generating suction in the suction cup when the fluid passes through the venturi tube. In this configuration, the device is used with a suction-inducing device that provides pressurized fluid, for example, a conventional air compressor.

In addition, the body may have a channel or well formed in it and an elongate spacer member that slides into the channel or well. The spacer is selectively extendible from and retractable into the channel or well, so that is can be adjusted to a variety of different positions. To secure the spacer in a selected position, the device may be provided with a fastener such as a lock nut or thumb screw.

Furthermore, the body may include one or more notches for receiving an end of a tool such as a tape measure or a chalk line. The notches can be positioned at an edge of the body or at a predetermined distance from the edge of the body to facilitate use of the device when positioned abutting another surface such as a vertical column or wall surface or a horizontal ceiling surface.

In a second exemplary embodiment of the present invention, the device includes both horizontal and vertical notches and spacers. In a third exemplary embodiment of the present invention, the device includes at least one retaining tab extending from the body adjacent the support surface. In a fourth exemplary embodiment of the present invention, the device includes a body having at least one recess for receiving the construction piece and with the support surface defined in the recess. And in a fifth exemplary embodiment of the present invention, the device includes an elongated body with two or more suction cups attached to it.

In another form of the invention, the invention includes a system for installing the construction pieces. The system includes one or more of the support devices in combination with the suction-inducing device. The suction-inducing device can be a compressor, vacuum pump, or other device.

Additionally, the present invention provides an exemplary method of installing siding or trim pieces on a building wall. The method includes the steps of providing at least one suction-attached support device, positioning the support device in a selected position on the building wall, controlling the support device so that it is adhered by suction in the selected position on the building wall, positioning the siding or trim pieces on the support device in a supported position, attaching the siding or trim pieces to the building wall, controlling the support device so that it is no longer adhered by suction in the selected position on the building wall, and removing the support device from the selected position on the building wall.

The step of positioning the support device may be accomplished by extending an elongate spacer member from the support device to an extended position, and abutting the spacer member against a previously installed siding or trim piece or other fixed part of the building. Additionally or alternatively, the step of positioning the support device may include positioning the support device abutting an existing surface, and the method may then include the steps of inserting an end of a tape measure into a notch in the support device, extending the tape measure to measure how long the siding or trim piece needs to be, and shortening the siding or trim piece to the measured length.

In another form of the invention, the invention includes a building with siding, trim, or other construction pieces installed according to the method just described.

In view of the foregoing, it will be appreciated that the present invention provides a way for one person to install siding, trim, and/or other construction pieces by himself without the assistance of a helper. In particular, the invention includes devices and methods enabling one person to quickly and easily position the construction piece in place on the building, hold the construction piece in place, and permanently nail it there.

The specific techniques and structures employed by the invention to improve over the drawbacks of the prior devices and methods and accomplish the advantages described herein will become apparent from the following detailed description of the exemplary embodiments of the invention and the appended drawings and claims.

DETAILED DESCRIPTION OF THE EXEMPLARY EMBODIMENTS

Figure 2:
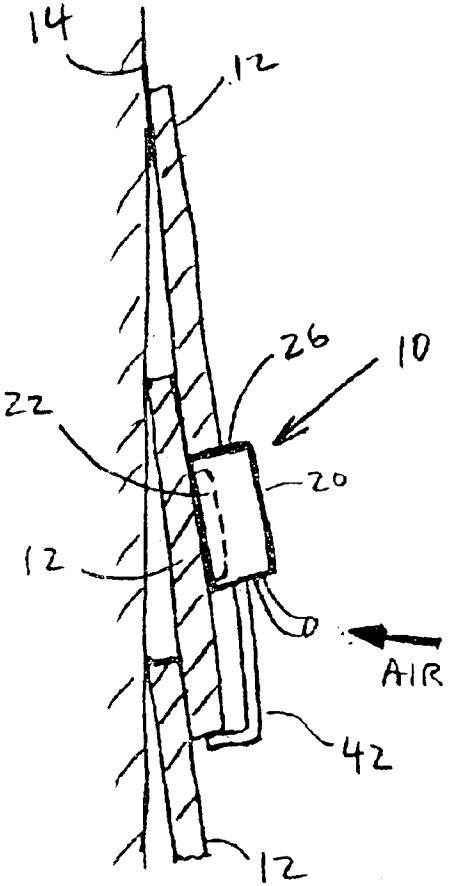
FIG. 2 is a sectional view, taken at line 2—2 of FIG. 1, showing the support devices, the siding pieces, and the building wall.
Figure 1:
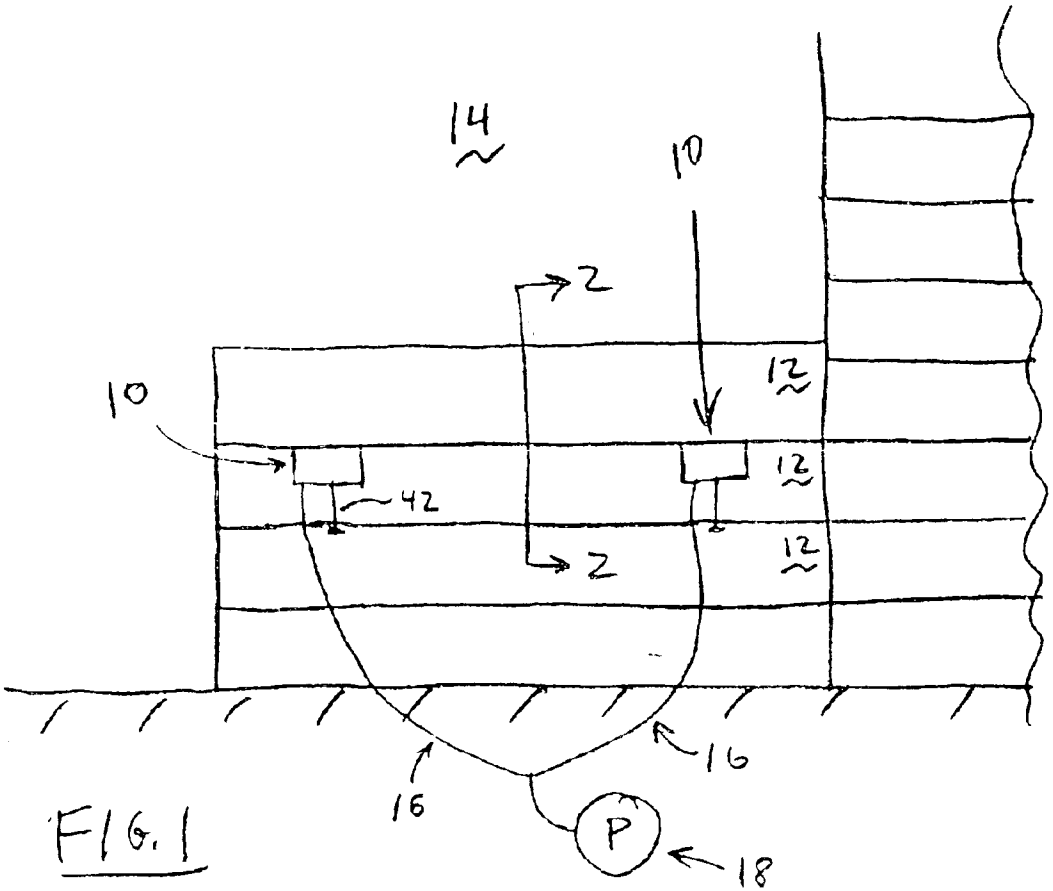
FIG. 1 is a front view of two support devices according to a first exemplary embodiment of the present invention being used to install siding pieces on a building wall.

Referring now to FIGS. 1–4, a first exemplary embodiment of the present invention provides a suction-attached support device 10, referred to generally as the device 10. As shown in FIGS. 1 and 2, the device 10 is used for installing construction pieces 12 on a building structure wall 14. The device 10 can be used to install construction pieces 12 such as siding, trim, or other items. The device 10 is connected by fluid lines 16 such as hoses to a suction-inducing device 18 such as a compressor, vacuum pump, or other device. The suction-inducing device 18 can operate using air or another fluid. It will be understood that the device 10 described herein is only one exemplary embodiment of the invention, and that those skilled in the art will recognize that the device can be adapted for use in other applications not expressly described herein but still included in the invention.

Figure 3:
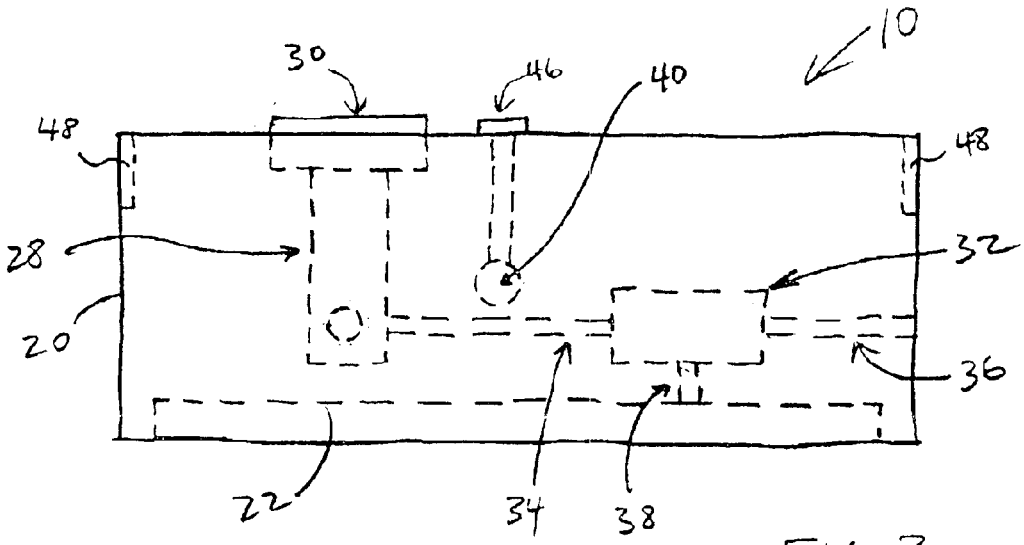
FIG. 3 is a top view of one of the support devices of FIG. 1, showing a body with a support surface and a suction cup.
Figure 4:
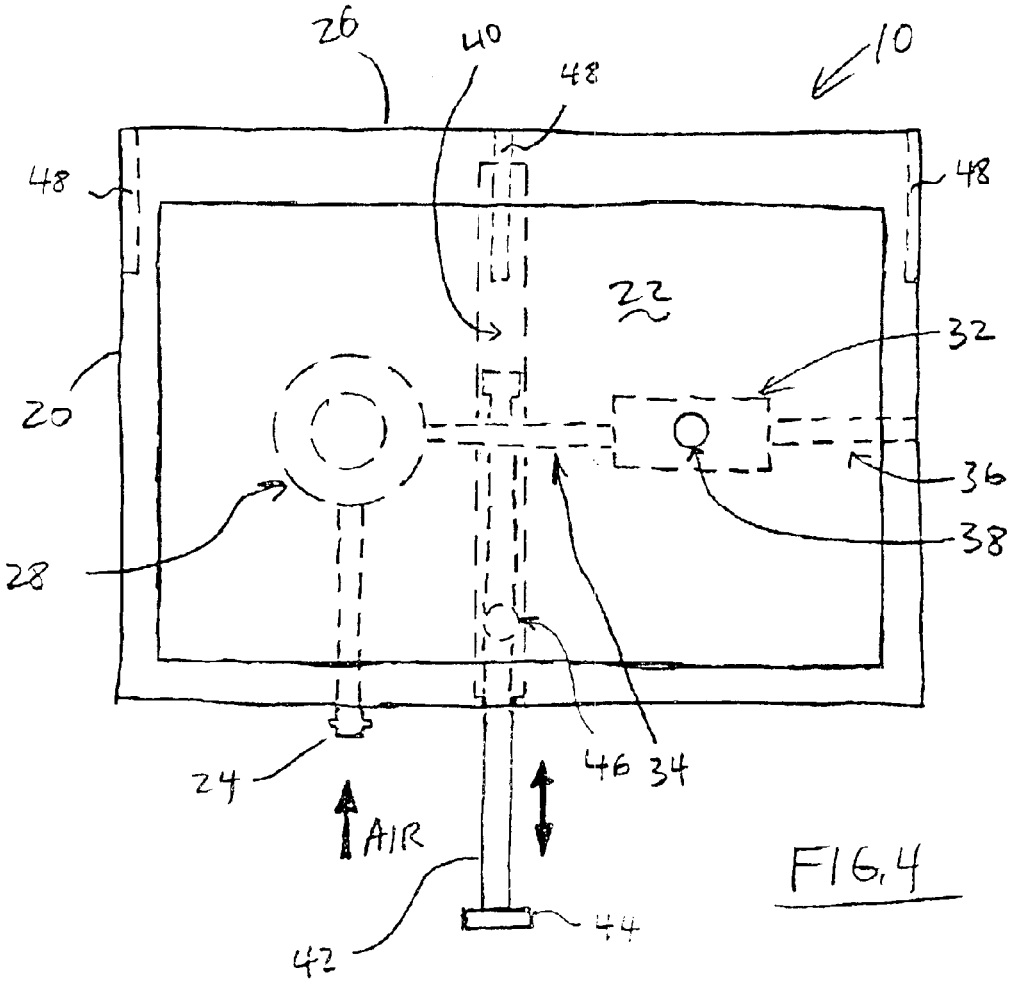
FIG. 4 is a back view of the support device of FIG. 3.

As shown in FIGS. 3 and 4, the device 10 includes a body 20, a suction cup 22 attached to the body, and a fluid line connector 24 attached to the body. The body 20 can have a rectangular, circular, or other regular or irregular shape. In addition, the body 20 can be made of a plastic, metal, composite, or other material selected for high strength and low weight. In a typical commercial embodiment, the body 20 is sized for holding in the user's hand, for example, about 7 inches wide, 4 inches high, and 2 inches deep. A convenient carrying handle and/or case can be included, if desired.

The body 20 has a support surface 26 for supporting the construction piece 12. For example, the support surface 26 may be flat, defined by the top side of the body 20, and include grip tape or another structure for frictionally engaging the construction piece 12. In this way, when the device 10 is temporarily mounted to the building 14, one person can lift and position the construction piece 12 on the support surface 26 where it will be supported while that same person nails, screws, or otherwise affixes it in place.

The suction cup 22 adheres the device 10 to the building structure 14 when suction is generated in the suction cup. The suction cup 22 can have a rectangular, conical, or other regular or irregular shape. In addition, the suction cup 22 is made of a flexible, shape-conforming airtight material such as rubber, a flexible polymer or a closed-cell foam selected for high strength, low weight, and durability over the course of many cycles of suctioning on and off. The suction cup 22 can be a housing having a commercially available seal around its circumference, or a specially-made body and seal arrangement. The suction cup 22 pref defines am airtight plenum when placed against a work surface, for maintaining a vacuum therein.

The fluid line connector 24 is in fluid communication with the suction cup 22 and adapted for coupling to the suction-inducing device 18 for generating suction in the suction cup. For example, the fluid line connector 24 can be a commercially available quick-connect and release pneumatic coupling for attaching the fluid line 16 from the suction-inducing device 18. In this way, the suction-inducing device 18 can be operated to generate the needed suction in the suction cup 22 to hold the suction cup to the building wall 14.

In addition, the device 10 may include a fluid flow control system having a flow valve 28 and knob 30, a vacuum pressure gauge, and/or other control components such as regulators and switches. In this way, the control system can be operated to selectively adjust up and down the suction generated in the suction cup 22 when the user desires to attach the device 10 to the building 14 for use and to remove it after use, respectively.

Preferably, the device 10 includes a venturi tube 32, an inlet fluid line 34, an outlet fluid line 36, and a suction fluid line 38. The venturi tube 32 may be a commercial type such as the Model Number NZHI05BST01-T01 Vacuum Generator provided by SMC Corporation of America of Indianapolis, Indiana. The inlet fluid line 34 is connected between the fluid line connector 24 and the venturi tube 32 for introducing fluid into the venturi tube. The outlet fluid line 36 is connected to the venturi tube 32 for exhausting the fluid from the venturi tube and from the body 20. And the suction fluid line 38 is connected between the venturi tube 32 and the suction cup 22. In this configuration, the suction-inducing device 18 can be provided by a conventional air (or other fluid) compressor for generating suction in the suction cup 22 when the fluid passes through the venturi tube 32. For a typical commercial embodiment of the device 10, a ½ HP or larger air compressor may be used.

Alternatively, the device 10 can be provided without the venturi tube 32 and outlet line 36. In this configuration, the suction-inducing device 18 can be provided by a conventional vacuum pump or a pneumatic compressor operating in reverse, connected in fluid communication with the device for generating suction in the suction cup 22. It will be understood by those skilled in the art that other suction-inducing mechanisms such as manual pumps can be used.

In addition, the device 10 preferably includes a channel or well 40 in the body 20 and a spacer member 42 that is received in the channel or well. The spacer 42 can be provided by an elongated bar, rod, etc., made of a metal, plastic, composite, or other material. The spacer 42 can be extended from and retracted into the channel 40 (as shown by the arrow in FIG. 4), as desired. For example, the spacer 42 can be retracted all the way into the well 40 for storing and transporting the device 10. And the spacer 42 can be extended to a selected position for abutting a previously installed construction piece 12 or part of the structure 14. The position is selected based on the size and shape of the construction pieces 12 and the wall 14, and the desired spacing between courses of construction pieces. Preferably, the spacer 42 includes a foot 44 for catching on the last siding piece installed (see FIG. 2). In this way, the device 10 can be quickly and easily positioned on the building 14 in exactly the same spot relative to the last siding piece installed, so that the next siding piece will be positioned consistently relative to the last piece. This eliminates the need to have a helper take measurements or stand back and check the position by eye.

In order to releasably secure the spacer 42 in the selected position, the device 10 can be provided with a releasable fastener 46 such as a threaded screw, lock nut, latch, or pin that engages the spacer, a series of teeth inside the well 40 and/or on the spacer that bind the spacer in place only when the spacer is rotated to a specific orientation, mating threads on the inside the well and on the spacer, or by other structures for releasably securing a member in place. Also, the spacer 42 may be provided with a spring for biasing it towards the retracted position and with graduations (e.g., inches and fractions thereof) marked on it.

Furthermore, the device 10 optionally includes at least one notch or projection 48 in or on the body 20 that is sized and shaped for receiving and holding an end of a tape measure or a chalk line. In a typical commercial embodiment, there are two edge notches and a center notch, each about 1 inch long and ⅛ inch wide. The notches 48 enable the installer to use a tape measure to quickly and easily measure how long the siding or other construction piece 12 needs to be and/or to use a chalk line to quickly and easily set up a vertical or horizontal reference line to aid in precisely positioning the pieces.

In the first embodiment just described, the device 10 is manufactured and sold by itself for use with an existing suction-inducing device 18, such as an air compressor or pump that the installer already has. In another aspect of the invention, there is provided a system for installing the construction pieces 12 on the building structure 14. The system includes one or more of the support devices 10 and one or more suction-inducing devices 18. In a typical commercial embodiment, the system includes two of the support devices 10, one air compressor 18, and air lines 16 with quick-connect couplings for connecting the compressor to the devices.

Figure 5:
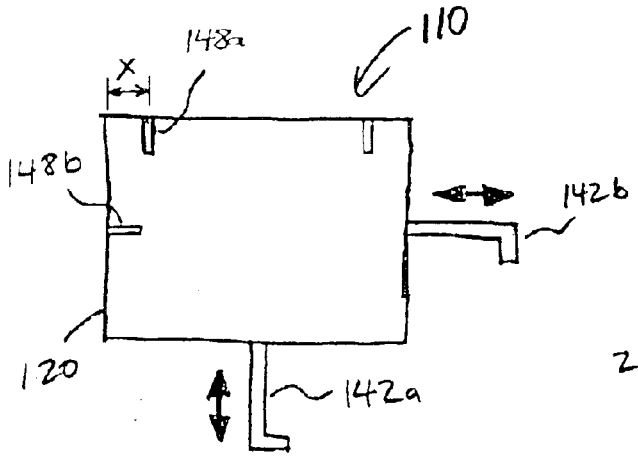
FIG. 5 is a front view of a support device according to a second exemplary embodiment, showing vertical and horizontal notches and spacers.

Referring now to FIG. 5, there is shown a second exemplary embodiment of the invention, generally referred to as the device 110. In this embodiment, the device 110 includes vertical notches 148*a* and horizontal notches 148*b* in the body 220, and vertical spacers 142*a* and horizontal spacers 142*b* retractably extending (as shown by the arrows) from the body. In this way, the several notches and spacers can be used to better position the device 110 and the construction piece 12 on the building wall. For example, the horizontal spacer 142*b* can be used for hanging wallpaper construction pieces, and the horizontal notches 148*b* can be used for receiving a chalk line to provide a vertical reference line.

In addition, one or more of the notches, such as notch 148*a*, is offset a predetermined distance "X" from an edge of the body 120. The predetermined distance "X" can be, for example, 1 inch. In this way, when the installer needs to position the device 110 flush against a surface of the building, the notch 148*a* is accessible for receiving the end of the tape measure. After taking a measurement with the tape measure, the installer simply adds the distance "X" to the measured distance to get the total distance from the edge of the body 120. This is very handy when using the device 110 to measure siding and trim pieces.

Figure 6:
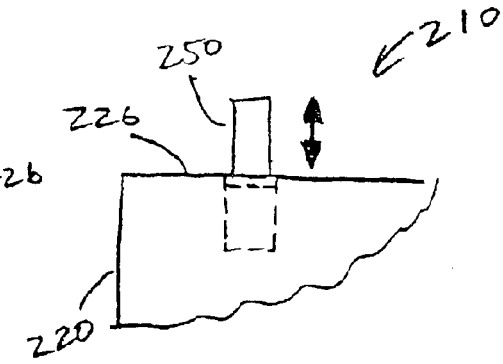
FIG. 6 is a partial front view of a support device according to a third exemplary embodiment, showing an extendible retaining tab for retaining the siding pieces in place.

Referring now to FIG. 6, there is shown a third exemplary embodiment of the invention, generally referred to as the device 210. In this embodiment, the device 210 includes at least one retaining tab 250 retractably extending (as shown by the arrow) from the body adjacent the support surface 226. A single elongate tab can be provided extending along a substantial portion of the length of the body, a series of shorter tabs can be provided, or a single short tab can be used, as desired. The retaining tab 250 can be extended for use to retain the construction pieces 12 in place supported by the support surface 226 and retracted after use for storage and transporting.

Figure 8:
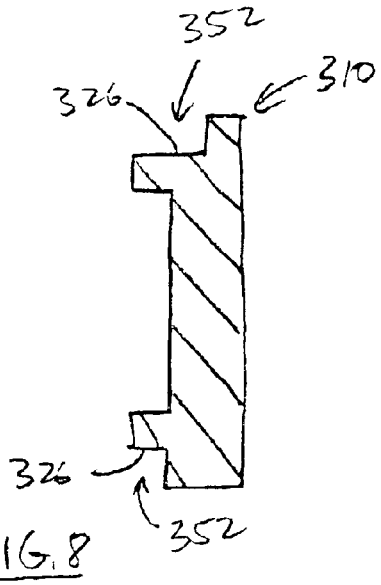
FIG. 8 is a sectional view taken at line 8—8 of FIG. 7, showing the support device having different depth recesses.
Figure 7:
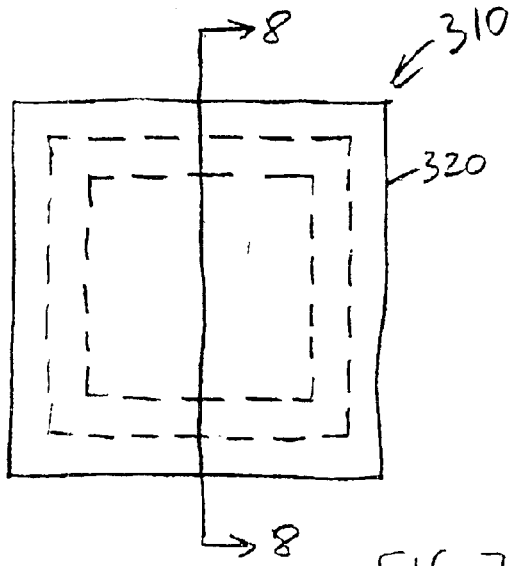
FIG. 7 is a front view of a support device according to a fourth exemplary embodiment, showing recesses for receiving and retaining the siding pieces in place.

Referring now to FIGS. 7 and 8, there is shown a fourth exemplary embodiment of the invention, generally referred to as the device 310. In this embodiment, the device 310 includes at least one recess 352 in the body 320, with the support surface 326 in the recess. The recess 352 receives and retains the construction piece in place supported by the support surface 326. In addition, a number of the recesses 352 can be provided. For example, the body 320 can be rectangular with each of the four sides having a recess 352, with each of the recesses having a different width (note that the top recess is wider than the bottom recess in FIG. 8) for use with construction pieces having different thicknesses. When mounting the device 310 to the building, it is oriented with the desired recess 352 on top. Stated another way, the body 320 can have one or more flanges on one or more sides for retaining the construction pieces in place.

Figure 9:
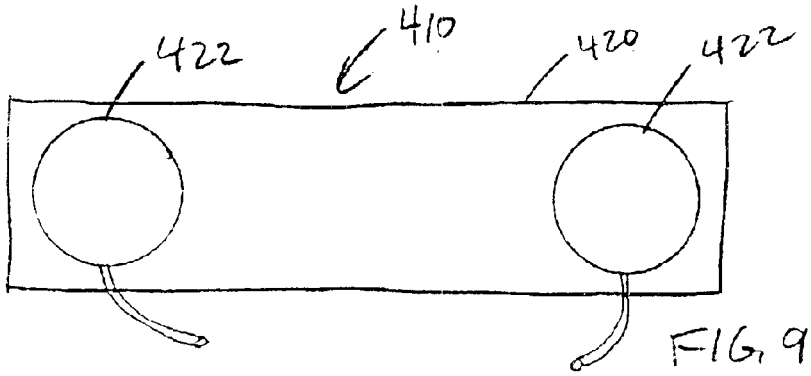
FIG. 9 is a front view of a support device according to a fifth exemplary embodiment, showing the body being elongated and having two suction cups.

Referring now to FIG. 9, there is shown a fifth exemplary embodiment of the invention, generally referred to as the device 410. In this embodiment, the device 410 includes an elongated body 420 with two (or more) suction cups 422 attached to it. In this way, only one device 410 is needed to install the construction pieces. In alternative embodiments, the body has a semicircular lower section that conforms to the shape of a circular suction cup, and a rectangular top section with a flat top for the support surface. In other alternative embodiments, the support surface is curved or sloped from the front towards the back of the body for retaining the construction piece in place on the body. In still other alternative embodiments, the body includes a conventional bubble-type level or laser-level for accurately positioning the device on the building. In yet other alternative embodiments, the device has a support surface that is adjustable for fine-tuning to make it exactly level after the device is adhered to the building wall.

In other alternative embodiments, the suction-inducing device is integrally provided in the body of the device. For example, the suction-inducing mechanism can be provided by a hand pump, in which case the fluid line connector is simply the fluid line connected between the pump and the suction cup. And in still other alternative embodiments, a system includes two devices connected by a telescopic, tracked, or other extendible connecting rod assembly so that they can be positioned beside each other for compact storage and, after one device is mounted to the building, the other device can be slid away from the first one for mounting to the building.

Referring back to FIGS. 1 and 2, another aspect of the invention provides a method of installing siding, trim, or other construction pieces 12 on a building wall 14. The method includes the use of one or more of the suction-attached support devices such as any of those described above. For convenience, the method will be described with reference to the device 10 of the first embodiment. Those skilled in the art will understand that substantially similar methods of installation may be carried out with the devices of other embodiments.

The method preferably includes the steps of positioning the device 10 in a selected position on the building wall 14, then controlling the device so that it is suctioned securely in place to the wall. Typically, two or more of the devices are used together, in which case another one of the devices 10 is then mounted to the building 14 in the same way. Next, the installer positions the construction piece 12 onto the devices 10 where it is supported in place, and nails or otherwise attaches the construction piece 12 to the building 14. Then the installer controls the device 10 to lessen or stop the suctioning, which releases the device from the building wall 14, and removes the device. These steps are then repeated in much the same fashion until the project is completed.

Preferably, the step of positioning the device 10 includes extending an elongate spacer 42 from the device to an extended position, and abutting the spacer against a previously installed construction piece 12 (see FIG. 2) or other fixed part of the building 14. The extended position of the spacer 42 is selected based on the size and desired overlap (if any) of the construction pieces 12 and the size of the building wall 14. In this way, the installer can quickly, easily, and precisely install each of the construction pieces 12 so that they are positioned in a consistent arrangement on the building wall without having to take time-consuming measurements.

Alternatively, when two of the devices 10 are used together and the installer is installing trim construction pieces, the first device 10 can be mounted to the building 14, the spacer 42 extended until it abuts an existing construction piece 12, the spacer on the second device set to the same position, and the second device installed. In this way, the construction piece can be precisely installed without taking any measurements in the conventional manner.

In addition, the step of positioning the device 10 may include, when needed, positioning the device abutting a vertical surface such as a wall, column, doorjamb, etc., or a horizontal surface such as a ceiling, floor, etc. Then the installer inserts an end of a tape measure in a notch 48 in the device 10, extends the tape measure to measure how long the siding or trim construction piece 12 needs to be, and shortens the piece to the measured length. If the installer is using a device 10 with a notch 48 that is offset by a predetermined distance from the edge of the device, then the installer simply adds the predetermined distance to the measurement before cutting the piece 12. In this way, the installer can by himself easily determine the length that the construction piece 12 needs to be shortened to by using the notch 48 of the device 10.

Accordingly, the present invention provides several advantages over the prior art. The invention enables one person to install siding, trim, and/or other construction pieces without the assistance of another person. In particular, the invention includes devices and methods which can be utilized by one person to temporarily mount a suction-mounted device to a building wall, quickly and easily position and hold the construction piece in place on the device, permanently nail the construction piece to the structure, and remove the suction-mounted device from the building wall.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. In addition, as used in the specification including the appended claims, the singular forms "a," "an," and "the" include the plural, plural forms include the singular, and reference to a particular numerical value includes at least that particular value, unless the context clearly dictates otherwise. Furthermore, any methods described herein are not intended to be limited to the sequence of steps described but can be carried out in other sequences, unless expressly stated otherwise herein.

While certain embodiments are described above with particularity, these should not be construed as limitations on the scope of the invention. It should be understood, therefore, that the foregoing relates only to exemplary embodiments of the present invention, and that numerous changes may be made therein without departing from the spirit and scope of the invention as defined by the following claims.

What is claimed is:

1. A device for use with at least one suction-inducing device to install a construction piece on a structure, comprising:

a body having at least one support surface adapted for supporting the construction piece;

a suction cup attached to the body and adapted for attaching the support device to the structure temporarily when suction is generated in the suction cup; and a fluid line connector in fluid communication with the suction cup and adapted for fluid connection with the suction-inducing device for generating suction in the suction cup.

2. The support device of claim 1, further comprising a venturi tube, an inlet fluid line connected between the fluid line connector and the venturi tube for introducing fluid into the venturi tube, an outlet fluid line connected to the venturi tube for exhausting the fluid from the venturi tube, and a suction fluid line connected between the venturi tube and the suction cup for generating suction in the suction cup when the fluid passes through the venturi tube.

3. The support device of claim 1, wherein the body includes a channel defined therein, and further comprising an elongate spacer member that is received in the channel and that is selectively extendible from and retractable into the channel.

4. The support device of claim 3, further comprising a fastener adapted for releasably securing the spacer member in a selected position.

5. The support device of claim 1, wherein the body includes at least one notch defined therein for receiving an end of a tape measure or a chalk line.

6. The support device of claim 5, wherein the notch is positioned a predetermined distance from an edge of the body.

7. The support device of claim 1, wherein the body includes at least one recess for receiving the construction piece and the support surface is defined in the recess.

8. The support device of claim 1, further comprising at least one retaining tab extending from the body adjacent the support surface.

9. The support device of claim 1, wherein the suction cup comprises two or more suction cups attached to the body.

10. A system for temporarily supporting a construction piece during installation on a structure, comprising one or more of the support devices of claim 1 in combination with a suction-inducing device.

11. A device for use with an air compressor to temporarily support a piece of siding or trim during installation on a building, comprising:

a body having at least one support surface adapted for supporting the siding or trim piece, one or more notches defined therein for receiving an end of a tape measure or a chalk line, and a channel defined therein;

an elongate spacer member that is received in the channel and that is selectively extendible from and retractable into the channel;

at least one suction cup attached to the body and adapted for attaching the support device to the building temporarily when suction is generated in the suction cup; and an air line connector, a venturi tube, an inlet air line connected between the air line connector and the venturi tube for introducing air into the venturi tube, an outlet air line connected to the venturi tube for exhausting the air from the venturi tube, and a suction air line connected between the venturi tube and the suction cup for generating suction in the suction cup when the air passes through the venturi tube.

12. The support device of claim 11, further comprising a fastener adapted for releasably securing the spacer member in a selected position.

13. The support device of claim 11, wherein at least one of the notches is positioned a predetermined distance from an edge of the body.

14. The support device of claim 11, further comprising a fluid flow control system for adjusting the suction generated in the suction cup.

15. A system for temporarily supporting a piece of siding or trim during installation on a building, comprising one or more of the support devices of claim 11 in combination with an air compressor.

16. A method of installing siding or trim pieces on a building wall, comprising:

providing at least one suction-attached support device;

positioning the support device in a selected position on the building wall;

controlling the support device so that it is adhered by suction in the selected position on the building wall;

positioning the siding or trim pieces on the support device in a supported position;

attaching the siding or trim pieces to the building wall;

controlling the support device so that it is no longer adhered by suction in the selected position on the building wall; and removing the support device from the selected position on the building wall.

17. The method of claim 16, wherein the step of positioning the support device in a selected position on the building wall comprises:

extending an elongate spacer member from the support device to an extended position;

abutting the spacer member against a previously installed siding or trim piece or other fixed part of the building.

18. The method of claim 16, wherein the step of positioning the support device in a selected position on the building wall comprises positioning the support device abutting a surface, and further including the steps of:

inserting an end of a tape measure in a notch in the support device;

extending the tape measure to measure how long the siding or trim piece needs to be; and shortening the siding or trim piece to the measured length.

19. The method of claim 16, further comprising repeating the second through seventh steps.

20. A building with siding or trim pieces installed according to the method of claim 16.

* * * * *